US008630428B2

(12) United States Patent
Yana et al.

(10) Patent No.: US 8,630,428 B2
(45) Date of Patent: Jan. 14, 2014

(54) DISPLAY DEVICE AND AUDIO OUTPUT DEVICE

(75) Inventors: Terutaka Yana, Tokyo (JP); Yutaka Miki, Chiba (JP); Yoshio Ohashi, Kanagawa (JP); Nobukazu Suzuki, Kanagawa (JP)

(73) Assignee: Thomson Licensing, Issy les Moulineaux (FR)

( * ) Notice: Subject to any disclaimer, the term of this patent is extended or adjusted under 35 U.S.C. 154(b) by 698 days.

(21) Appl. No.: 12/804,512

(22) Filed: Jul. 22, 2010

(65) Prior Publication Data

US 2011/0025927 A1 Feb. 3, 2011

(30) Foreign Application Priority Data

Jul. 30, 2009 (JP) ..... P2009-178136

(51) Int. Cl.
*H04R 1/40* (2006.01)
*H04R 9/06* (2006.01)
*H04R 1/02* (2006.01)

(52) U.S. Cl.
USPC ..... 381/97; 381/333; 381/388

(58) Field of Classification Search
USPC ..... 381/306, 27, 97, 333, 388, 99; 391/99
See application file for complete search history.

(56) References Cited

U.S. PATENT DOCUMENTS

| | | | | | |
|---|---|---|---|---|---|
| 4,229,619 | A | * | 10/1980 | Takahashi et al. | 381/99 |
| 4,885,782 | A | * | 12/1989 | Eberbach | 381/186 |
| 5,854,847 | A | * | 12/1998 | Yoshida et al. | 381/302 |
| 5,930,376 | A | * | 7/1999 | Markow et al. | 381/333 |
| 8,126,182 | B2 | * | 2/2012 | Chang | 381/334 |

FOREIGN PATENT DOCUMENTS

| | | | |
|---|---|---|---|
| JP | 02-059000 | A | 2/1990 |
| JP | 09-037384 | A | 2/1997 |
| JP | 2000-59897 | * | 2/2000 |

OTHER PUBLICATIONS

Machine translation of JP2000-59897, Feb. 25, 2000, 4 pages.*

* cited by examiner

*Primary Examiner* — Ping Lee
(74) *Attorney, Agent, or Firm* — Robert D. Shedd; Richard LaPeruta

(57) ABSTRACT

A display device includes a display portion that displays video, a first audio output portion that outputs stereo audio of a high frequency range, and that is a surface sound source positioned on a rear surface of the display portion, on one of an upper section and a lower section of the display portion, a second audio output portion that outputs stereo audio of a lower frequency range, and that is one of a surface sound source and a point sound source positioned on the rear surface of the display portion, on which the first audio output portion is not positioned, and a delaying portion that delays output of the second audio output portion to be later than output of the first audio output portion.

14 Claims, 13 Drawing Sheets

POSITION OF VIRTUAL SOUND IMAGE CREATED BY POINT SOUND SOURCE

FIG.13

| SAMPLE | X | H | Y | θ | L | Delay | LOCALIZED POSITION |
|---|---|---|---|---|---|---|---|
| 1 | 25 | 21.65 | 67.5 | 90 | 70.88704 | 2200 | CANNOT RAISE LOCALIZED POSITION. |
| 2 | 25 | 21.65 | 64 | 90 | 67.56273 | 2020 | ALTHOUGH LOCALIZED POSITION CAN BE RAISED, IT IS HEARD OVERLAPPING. |
| 3 | 25 | 21.65 | 59 | 90 | 62.84682 | 1812 | LOCALIZED POSITION CAN BE RAISED. SOMETIMES HEARD FROM MAIN SIDE. |
| 4 | 25 | 21.65 | 48 | 90 | 52.65665 | 1437 | LOCALIZED IN CENTER. |
| 5 | 25 | 21.65 | 48 | 45 | 36.09809 | 800 | LOCALIZED IN CENTER. |
| 6 | 25 | 21.65 | 38 | 45 | 27.37241 | 400 | LOCALIZED IN CENTER. |
| 7 | 25 | 21.65 | 67.5 | 45 | 54.39004 | 1400 | LOCALIZED IN CENTER. |
| 8 | 50 | 43.301 | 67.5 | 45 | 47.93473 | 1250 | LOCALIZED IN CENTER. |
| 9 | 25 | 0 | 48 | 180 | 48 | 1200 | LOCALIZED IN CENTER. |

AT DELAY OF 2000μs OR MORE, LOCALIZED POSITION CANNOT BE RAISED. PERCEIVED AS SEPARATE SOUNDS.

IF IN RANGE THAT CAN BE ADJUSTED TO DELAY OF 1800μs OR LESS, LOCALIZED POSITION CAN BE LOWERED.

DISPLAY DEVICE AND AUDIO OUTPUT DEVICE

CROSS-REFERENCE TO RELATED APPLICATION

The present application claims priority from Japanese Patent Application No. JP 2009-178136 filed in the Japanese Patent Office on Jul. 30, 2009, the entire content of which is incorporated herein by reference.

BACKGROUND OF THE INVENTION

1. Field of the Invention

The present invention relates to a display device and an audio output device.

2. Description of the Related Art

On video/audio playback devices, such as a television receiver, that output audio and display video, speakers are positioned above or below a screen of the device, or the speakers are positioned to the left and the right of the screen etc. The screen and the speakers are integrated or are formed separately. In known art, technology is known in which video and audio are matched by adjusting the position of a sound field formed by audio output from the television receiver.

For example, as disclosed in Japanese Patent Application Publication No. JP-A-9-37384, speakers that are positioned on an upper or lower side of a video playback device play back a center channel signal in which a level of a specific bandwidth, in a bandwidth of 4 kHz or more, has been suppressed. Further, speakers positioned on the left and the right of the video playback device play back the center channel signal of the specific bandwidth. In addition, as disclosed in Japanese Patent Application Publication No. JP-A-2-59000, an audio signal is separated into a frequency bandwidth in which a sense of direction can be obtained acoustically, and another frequency bandwidth. Then, the phase and the sound pressure level of the audio signal of the bandwidth in which a sense of direction can be obtained are adjusted, and a plurality of speakers are used to control localization of a sound image. Sound image localization is not performed on the audio signal of the other frequency bandwidth, and a single speaker is used to play back the audio signal of this bandwidth.

SUMMARY OF THE INVENTION

In recent years, due to the influence of increasingly flatter television receivers, limitations are placed on the positioning of speakers that are integrated with the screen of the television receiver. When the thickness of the screen portion, which accounts for the most part of the television receiver, is reduced, for example, to the order of 10 or so millimeters or a few millimeters, the speakers tend to be provided below the screen. In particular, speakers that can output audio of, for example, 20 Hz to 20 kHz, require a certain size (volume) in order to maintain quality of sound, and are not located in the vicinity of the screen that has been made flatter, but are located below the screen. Even if full range speakers that have successfully been made flatter are located in the vicinity of the screen, it is not possible to secure the size (volume) of the speakers, and, it is easy for low range audio of, for example, 100 Hz or less, to deteriorate.

When the speakers are located below the screen of the television receiver, it is possible to locate the speakers on the left and the right and output stereo sound, and by adjusting the sound volume of the left and right speakers, sound image localization, (here, the localized position of the sound image) can be moved in the left-to-right direction. However, due to limitations caused by the increasingly low profile of the television receiver, when speakers are located below the screen only, the localized position of the sound image remains biased below the screen, and it is not possible to move the localized position of the sound image to the center of the screen in the height direction.

Furthermore, on the low-profile display panel, for example, it is preferable for the speakers to be as unnoticeable as possible, and with this type of structure, a viewer can concentrate on the video of the panel. For that reason, in future, it is possible that display devices will become the norm that display the screen on the whole panel. However, in this type of display device, if it is assumed that the speakers are located on a rear surface of the panel, in order to provide sound to the user, it is necessary to position the speakers on the edges of the panel. With this type of structure, audio is heard biased toward the edges of the panel, with a high risk that the user will experience a sense of discomfort. Additionally, even if the speakers are located on a plurality of edges, as the audio is heard individually from each of the speakers, it is difficult to provide high sound quality audio that has a sense of realism.

In light of the foregoing, it is desirable to provide a novel and improved display device and audio output device that allow a flatter screen, and can match a localized position of a sound image with a position of the screen, without any deterioration in sound quality.

According to an embodiment of the present invention, there is provided a display device includes a display portion that displays video, a first audio output portion that outputs stereo audio of a high frequency range, and that is a surface sound source positioned on a rear surface of the display portion, on one of an upper section and a lower section of the display portion, a second audio output portion that outputs stereo audio of a lower frequency range than the first audio output portion, and that is one of a surface sound source and a point sound source positioned on the rear surface of the display portion, on one of the upper section and the lower section of the display portion on which the first audio output portion is not positioned, and a delaying portion that delays output of the second audio output portion to be later than output of the first audio output portion.

In this configuration, an overlapping area is created between frequencies of the audio output by the first audio output portion and frequencies of the audio output by the second audio output portion.

In this configuration, the overlapping area is a bandwidth between 1 kHz and 3 kHz.

In this configuration, a time by which the output of the second audio output portion is delayed with respect to the output of the first audio output portion is 2 ms or less.

In this configuration, the display device further includes a third audio output portion that outputs audio at an even lower frequency range than the second audio output portion, and a second delaying portion that delays output of the second audio output portion to be later than output of the third audio output portion.

In this configuration, an overlapping area is created between frequencies of the audio output by the second audio output portion and frequencies of the audio output by the third audio output portion.

In this configuration, a time by which the output of the second audio output portion is delayed with respect to the output of the third audio output portion is 2 ms or less.

In this configuration, the third audio output portion is positioned below the display portion.

According to another embodiment of the present invention, there is provided an audio output device includes a first audio output portion that outputs audio of a high frequency range, and that is a surface sound source, a second audio output portion that outputs audio of a lower frequency range than the first audio output portion, that is one of a surface sound source and a point sound source and that is positioned separated from the first audio output portion, and a delaying portion that delays output of the second audio output portion to be later than output of the first audio output portion, and causes a localized position of a sound image by the second audio output portion to move toward the first audio output portion.

In this configuration, an overlapping area is created between frequencies of the audio output by the first audio output portion and frequencies of the audio output by the second audio output portion.

In this configuration, the overlapping area is a bandwidth between 1 kHz and 3 kHz.

In this configuration, a time by which the output of the second audio output portion is delayed with respect to the output of the first audio output portion is 2 ms or less.

In this configuration, the audio output device according to claim 9, further includes a third audio output portion that outputs audio at an even lower frequency range than the second audio output portion, and a second delaying portion that delays output of the second audio output portion to be later than output of the third audio output portion.

According to the present invention, it is possible to have a flatter screen, and to match a localized position of a sound image with a position of the screen, without any deterioration in sound quality.

BRIEF DESCRIPTION OF THE DRAWINGS

FIG. 12 is a characteristic diagram showing a relationship between a value L in. FIG. 11 and an optimum delay value;

FIG. 13 is a table showing results, for a variety of sizes of display panel, of calculating an optimum delay time in order to localize a source of sound in a center in the height direction;

DETAILED DESCRIPTION OF THE EMBODIMENT(S)

Figure 1:
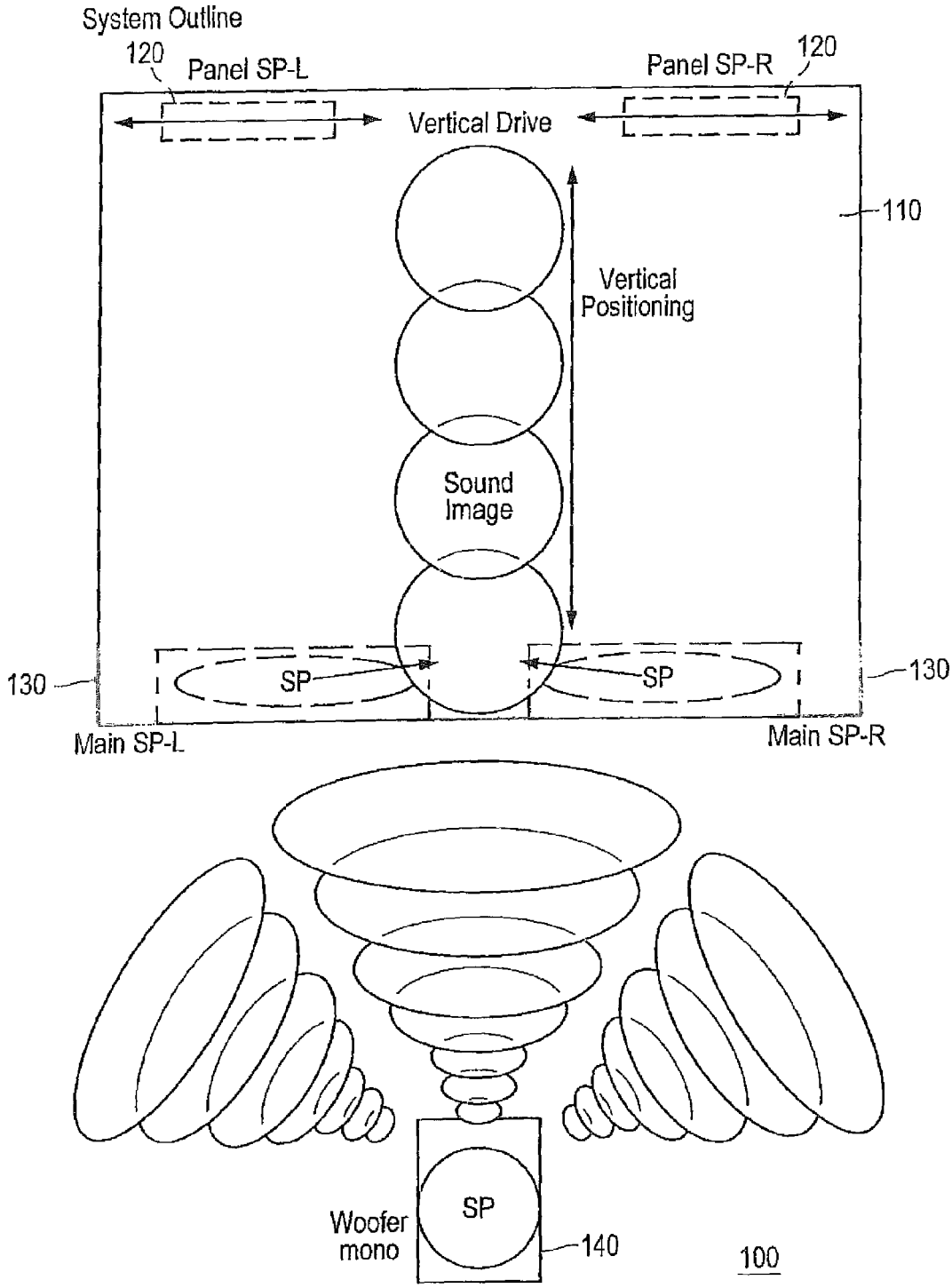
FIG. 1 is a front view showing a television receiver according to a present embodiment.

Hereinafter, preferred embodiments of the present invention will be described in detail with reference to the appended drawings. Note that, in this specification and the appended drawings, structural elements that have substantially the same function and structure are denoted with the same reference numerals, and repeated explanation of these structural elements is omitted.

Note that, the explanation will be given in the following order.

1. Overall structure of television receiver
2. Three-way speaker system of television receiver
3. Structure to raise localized position of sound image of main speakers
4. Structure to raise localized position of sound image of woofer
5. Function block structure of television receiver 1. Overall Structure of Television Receiver First, a structure of a television receiver 100 according to a present embodiment of the present invention will be explained with reference to FIG. 1 and FIG. 2. FIG, is a front view showing the television receiver 100 according to the present embodiment. FIG. 2 is a side view showing a state in which a front surface of the television receiver 100 according to the first embodiment is viewed from the left side.

The television receiver 100 i,s an example of a video/audio playback device, and displays video on a display portion (display panel) 110, based on television broadcast signals and video and audio signals input from an external device etc. The display panel 110 can be, for example, a liquid crystal display panel, but the display panel 110 is not limited to this example. Moreover, the television receiver 100 outputs audio from panel speakers (panel SP-R and panel SP-L) 120, main speakers (main SP-R and main SP-L) 130 and a woofer (woofer mono) 140. Note that, in the present embodiment, the television receiver 100 exemplifies the video/audio playback device, but the video/audio playback device is not limited to the example of the television receiver 100. The video/audio playback device may be, for example, a display device that does not have a function to receive television broadcast signals but can reproduce video and audio of content that is recorded on a recording medium or content that is distributed by streaming etc. The video/audio playback device may alternatively be a personal computer, or a portable device, such as a PDA etc. Furthermore, a video/audio output device according to the present embodiment can be, for example, a device that is formed of structural members mainly relating to audio output, such as a headphone player, in which a localized position of the sound image is caused to be moved even when image display is not performed.

Figure 2:
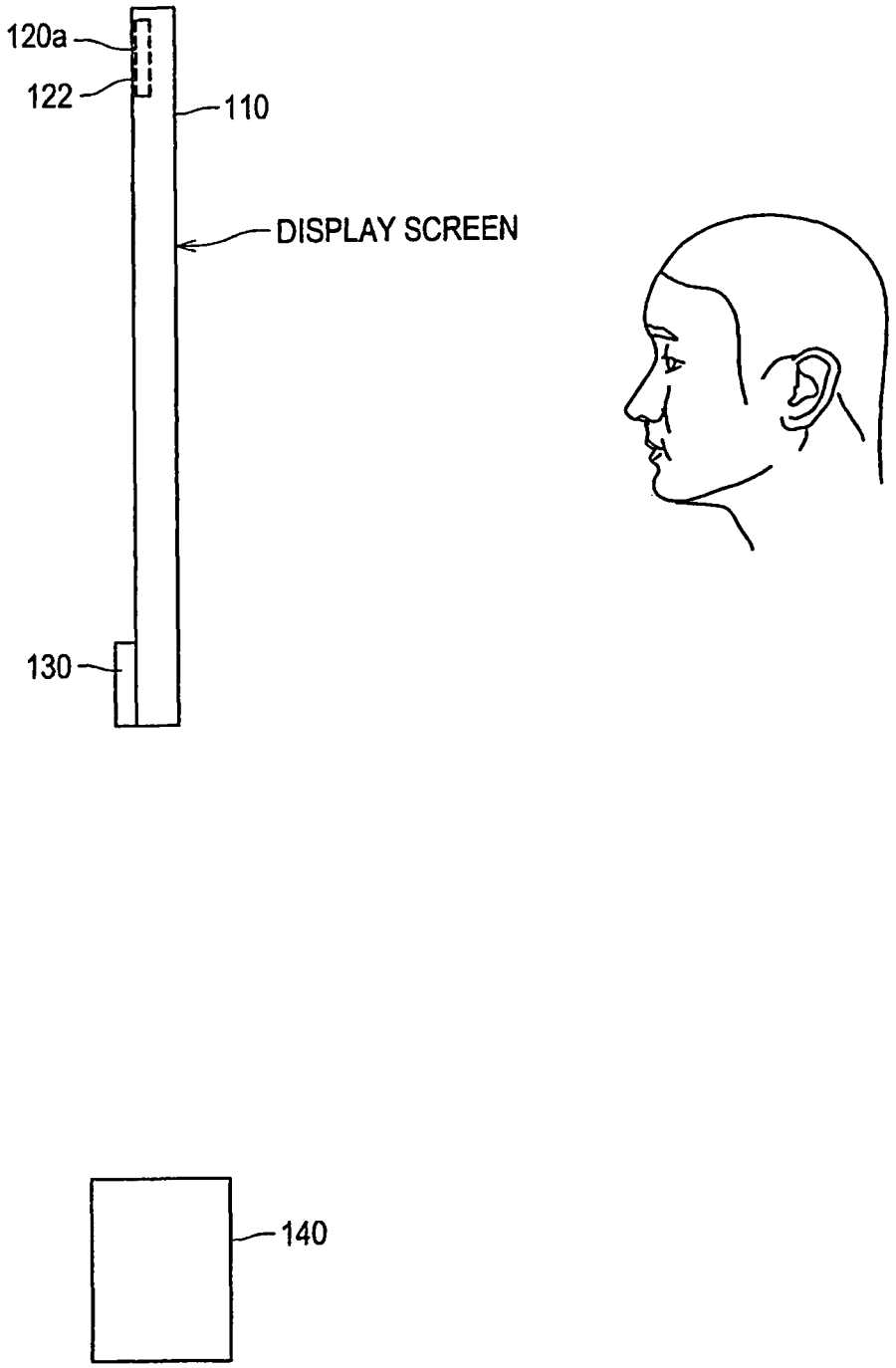
FIG. 2 is a side view showing a state in which a front surface of the television receiver according to the present embodiment is viewed from the left side.

As shown in FIG. 1 and FIG. 2, the panel speakers 120 are provided on an upper section of a rear surface of the display panel 110, one on the left side and one on the right side. The panel speakers 120 are speakers that output high frequency audio, in stereo. The panel speakers 120 are formed of piezo elements (piezo-electric elements) that vibrate in the vertical direction, and are mounted on a metal rear panel 122 that is provided on the rear surface of the display panel 110. When the panel speakers 120 vibrate in the vertical direction, curvature movement occurs in the rear panel 122 due to a difference in the rigidity of the rear panel 122 and the piezo elements. As a result, the rear panel 122 vibrates in a direction perpendicular to its surface, and audio generated by this vibration. Accordingly, the panel speakers 120 function as surface sound source speakers by the vibration of the rear panel 122. In this way, in the panel speakers 120, there is a perpendicular (orthogonal) relationship between the vibration direction of the piezo elements and a direction of propagation of sound by the vibration of the rear panel 122. In the present specification and appended drawings, the audio output drive of the panel speakers 120 by this relationship is referred to as vertical drive.

Further, the main speakers 130 are provided on a lower section of the rear surface of the display panel 100, one on the left side and one on the right side. The main speakers 130 are speakers that output midrange frequency audio, in stereo. The main speakers 130 are point sound source speakers, and can be conventional general-purpose speakers. As will be explained in more detail later, in the present embodiment, due to a precedence effect of the panel speakers 120, the main speakers 130 can be adjusted such that a position of the sound source of the main speakers 130 seems to be in a center of the display panel 110 in the height direction. Note that, in the present embodiment, the panel speakers 120 are positioned on the upper section of the display panel 110, and the main speakers 130 are positioned on the lower section of the display panel 110, but the main speakers 130 may be positioned on the upper section and the panel speakers 120 may be positioned on the lower section. Furthermore, the main speakers 130 may be surface sound source speakers.

The woofer 140 is located sufficiently below the display panel 110. When the display panel 110 is installed in a wall, the woofer 140 can be placed on the floor, for example. The woofer 140 is a speaker that outputs low frequency monaural audio. When the television receiver 100 is provided with a device such as an A/C adaptor, the woofer 140 may be integrated with this type of device.

2. Three-Way Speaker System of Television Receiver

Figure 3:
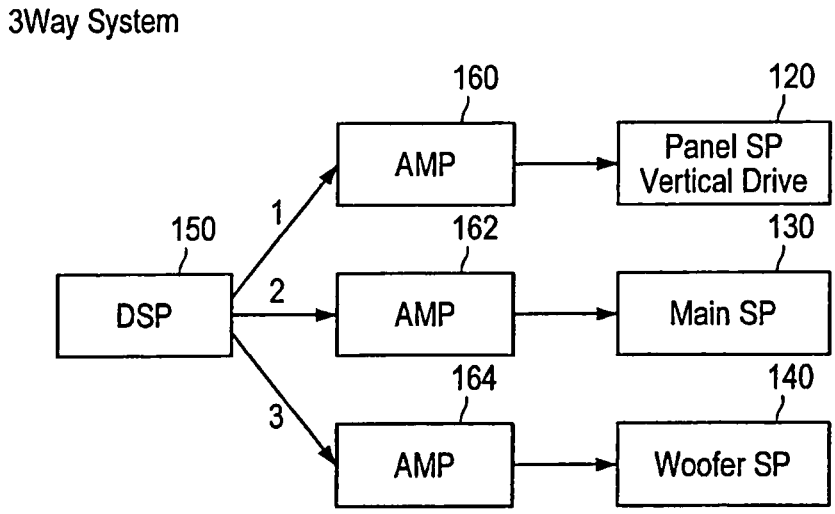
FIG. 3 is a schematic diagram showing a three-way system of the television receiver, formed of panel speakers, main speakers and a woofer.

FIG. 3 is a schematic diagram showing a three-way system of the television receiver 100, the three-way system including the panel speakers 120, the main speakers 130 and the woofer 140. As shown in FIG. 3, the television receiver 100 includes a digital signal processor (DSP) 150, and amplifiers 160, 162 and 164.

Audio signals acquired from broadcast signals are input into the DSP 150. The audio signals are respectively input to the amplifier 160 of the panel speakers 120, the amplifier 162 of the main speakers 130 and the amplifier 164 of the woofer 140. Then, output of each of the amplifiers 160, 162 and 164 is input to the panel speakers 120, the main speakers 130 and the woofer 140, respectively, and audio is output from the panel speakers 120, the main speakers 130 and the woofer 140.

Figure 4:
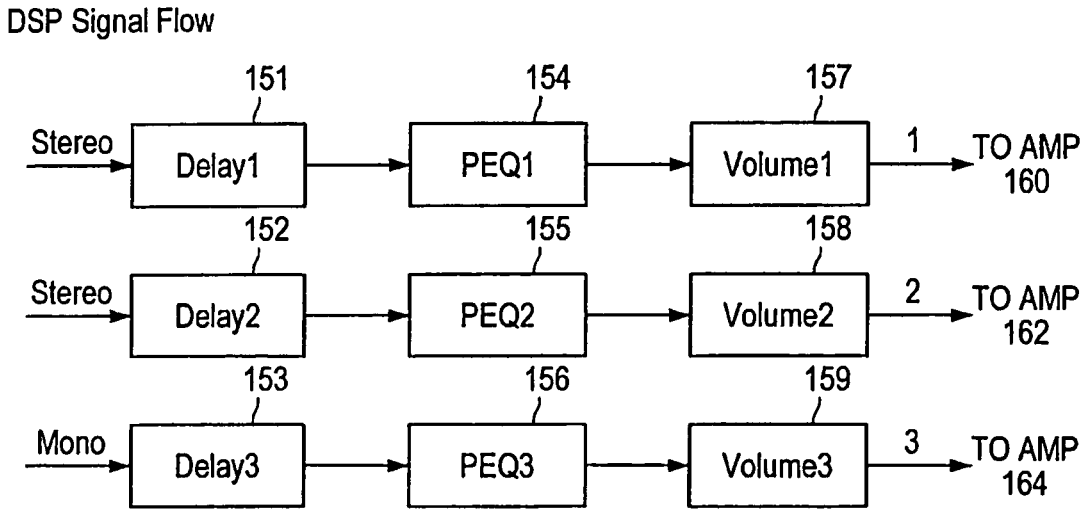
FIG. 4 is a schematic diagram showing a flow of signal processing by a DSP.

FIG. 4 is a schematic diagram showing a flow of signal processing by the DSP 150. As shown in FIG. 4, delay processing portions 151, 152 and 153 are provided in the DSP 150 with respect to each of the audio signals input to the panel speakers 120, the main speakers 130 and the woofer 140, respectively, and a delay times of each of the audio signals is set by the delay processing portions 151 to 153. In addition, a frequency of each of the audio signals is adjusted in frequency adjusting portions 154, 155 and 156. Further, a volume of each of the audio signals is set in volume setting portions 157, 158 and 159. Then, by optimally setting the delay time, the frequency and the volume of the audio signals input to the panel speakers 120, the main speakers 130 and the woofer 140, the television receiver 100 according to the present embodiment achieves an acoustic effect in which the audio from the panel speakers 120, the main speakers 130 and the woofer 140 seems to be output from the vicinity of the center of the display panel 110, in the height direction.

Hereinafter, the three-way system of the television receiver 100 will be explained in more detail. First, structures of the panel speakers 120, the main speakers 130 and the woofer 140 will be respectively described.

The panel speakers 120, also referred to as rear cover tweeters, are structured by fixing piezo elements to the rear panel 122 by wedge pressure. The two left and right piezo elements are positioned symmetrically with respect to the center of the display panel 110 in the horizontal direction, and each of the piezo elements performs expansion/contraction movements in the vertical direction. Further, the piezo elements are positioned at a highest position on the display panel 110, and removed as far as possible from the center of the display panel 110 in the horizontal direction. Then, to achieve separation, a center of the left and the right piezo elements is fixed by screw to the rear cover. By causing the expansion/contraction movements in the vertical direction of the piezo elements using this structure, vertical drive is caused in the rear cover.

Then, the panel speakers 120 with this structure mainly output sound of a high frequency of 1.5 kHz or more. Then, as the rear panel 122 itself can be caused to vibrate by the vertical drive, the rear panel 122 can be caused to function as a surface sound source, and it is thus possible to create a perception that the sound can be heard from the whole screen.

The main speakers 130 are positioned at a height between the panel speakers 120 and the woofer 140. In the present embodiment, the main speakers 130 are positioned on the rear surface of the lower section of the display panel 110, as described above. The main speakers 130 have functions to determine, for the sound generated by the television receiver 100, a sense of volume of the whole sound and a sound quality of a sound image. It is therefore desirable for a sound axis direction created by the main speakers 130 to be as close as possible to a user's viewing and listening position.

The main speakers 130 mainly output sound of a midrange frequency between approximately 200 Hz to 2 kHz. The main speakers 130 are important factors affecting the sense of volume of the localized sound, and the sound quality and focus of the sound image. In the present embodiment, dynamic speakers, which output audio in right and left stereo, are used as the main speakers 130.

The woofer 140 is positioned lowermost n the three-way speaker system. The woofer 140 fulfills a function to create a sense of bass sound of the whole sound. As the sound directivity of bass sound is low, the woofer 140 can be positioned freely. As a result, as described above, the woofer 140 can be integrated with a device such as an A/C adaptor etc., and can be positioned below the display panel 110. Because the directivity is low, there are relatively few restrictions on the direction in which the sound is generated, and thus, the direction of generation of the sound can be a chosen direction.

The woofer 140 mainly outputs sound of a low frequency of 300 Hz or less, using a low directivity frequency bandwidth, thus outputting a bass range feeling that is required for audio. Then, as will be described in more detail later, by adjusting a delay between the high range sound output by the panel speakers 120 and the midrange sound output by the main speakers 130, the localized position of the low range sound is raised higher, and a structure is achieved in which the low range sound seems to be generated from the center of the display panel 110. In the present embodiment, the input signal of the woofer 140 is monaural, and the woofer 140 is a dynamic speaker.

3. Structure to Raise Localized Position of Sound Image of Main Speakers

Next, delay processing by the DSP 150 will be explained. First, delay processing of the audio of the main speakers 130 with respect to the audio of the panel speakers 120 will be explained. Normally, when high range and mid range speakers are positioned respectively above and below the display panel, the high range and mid range sounds are heard from above and below independently, and thus a sense of integrated sound is lost. In the present embodiment, superimposed (cross over) areas are provided in the frequencies of the panel speakers 120 and the main speakers 130, and the sound of the main speakers 130 is delayed with respect to the sound of the panel speakers 120. In this way, the localized position of the sound image of the main speakers 130 is raised, and the sound can thus seem to be heard from approximately the center of the display panel 110 in the height direction.

Figure 5:
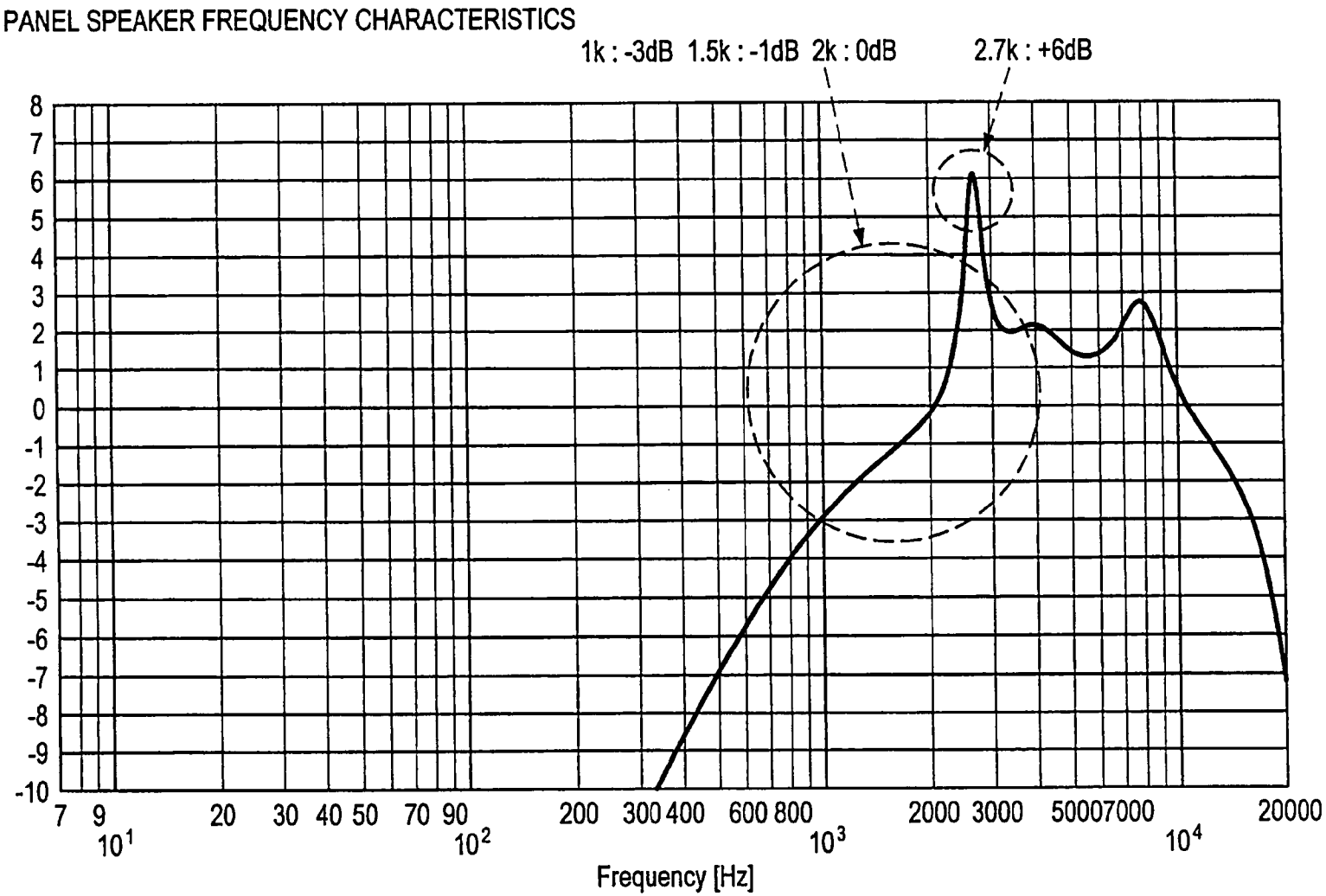
FIG. 5 is a characteristic diagram showing frequency characteristics of the panel speakers.
Figure 6:
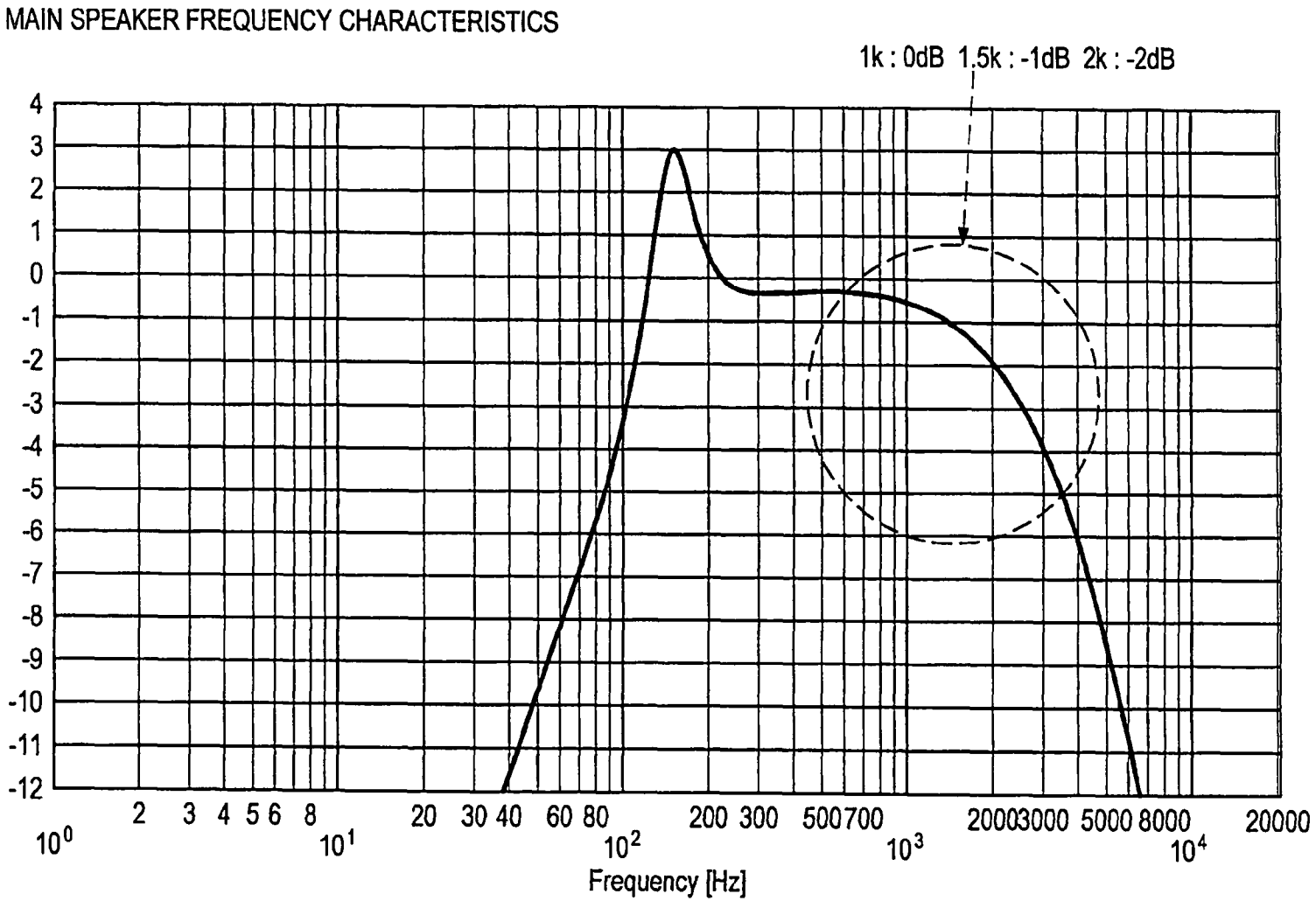
FIG. 6 is a characteristic diagram showing frequency characteristics of the main speakers.

FIG. 5 is a characteristic diagram showing frequency characteristics of the panel speakers 120. FIG. 6 is a characteristic diagram showing frequency characteristics of the main speakers 130. As shown in FIG. 5, in the frequency characteristics of the panel speakers 120, gain deteriorates in a bandwidth that is lower than approximately 2.7 kHz. On the other hand, in the frequency characteristics of the main speakers 130, gain deteriorates in frequencies higher than approximately 1 kHz. As shown in FIG. 5 and FIG. 6, audio in the frequency bandwidth from 1 kHz to 3 kHz is output from both the panel speakers 120 and the main speakers 130 and thus, the audio in this bandwidth is superimposed and output from the panel speakers 120 and the main speakers 130. As shown in FIG. 5, in the panel speakers 120, the gain from 1 kHz to 2 kHz is around −3 dB to 0 dB. As shown in FIG. 6, in the main speakers 130, the gain from 1 kHz to 2 kHz is around 0 dB to −2 dB.

The television receiver 100 according to the present embodiment adjusts delay using the delay processing portions 151 and 152 of the DSP 150, and outputs the audio from the panel speakers 120 in advance of the audio from the main speakers 130 by an extremely small time period. In this case, an advance time period is a time period of 2 msec or less. By outputting the audio of the panel speakers 120 in advance, the localized position of the sound of the main speakers 130 can be raised, by a precedence effect, toward the panel speakers 120. As a result, regardless of whether or not the main speakers 130 are mounted on the lower section of the display panel 110, it is possible to impart to a viewer the perception that the audio is generated from a height position around the center of the display panel 110.

As described above, the audio in the frequency bandwidth from 1 kHz to 3 kHz is output from both the panel speakers 120 and the main speakers 130, and the audio of this frequency bandwidth corresponds to the frequency of the higher harmonics of the human voice. The frequency of the human voice is around 150 Hz to 300 Hz for men and around 600 Hz to 700 Hz for women and the high harmonics mostly correspond to a frequency from 1 kHz to 3 kHz. The audio output from the television receiver 100, such as a news program, a drama etc., mainly includes human voices, and the frequencies of the higher harmonics of the voices and incidental music etc. are mostly around 1 kHz to 3 kHz. Therefore, by causing both the panel speakers 120 and the main speakers 130 to output audio of frequencies from 1 kHz to 3 kHz, and by outputting the audio of the panel speakers 120 at a slightly earlier time, the localized position of the sound image of the audio of the main speakers 130 is raised. By doing this, it is possible to move the audio of the main speakers 130 in the upward direction in the height direction of the display panel 110. As a result, it is possible to impart to the viewer the perception that the sound from the main speakers 130 and from the panel speakers 120 is generated from the center of the display screen.

Figure 7:
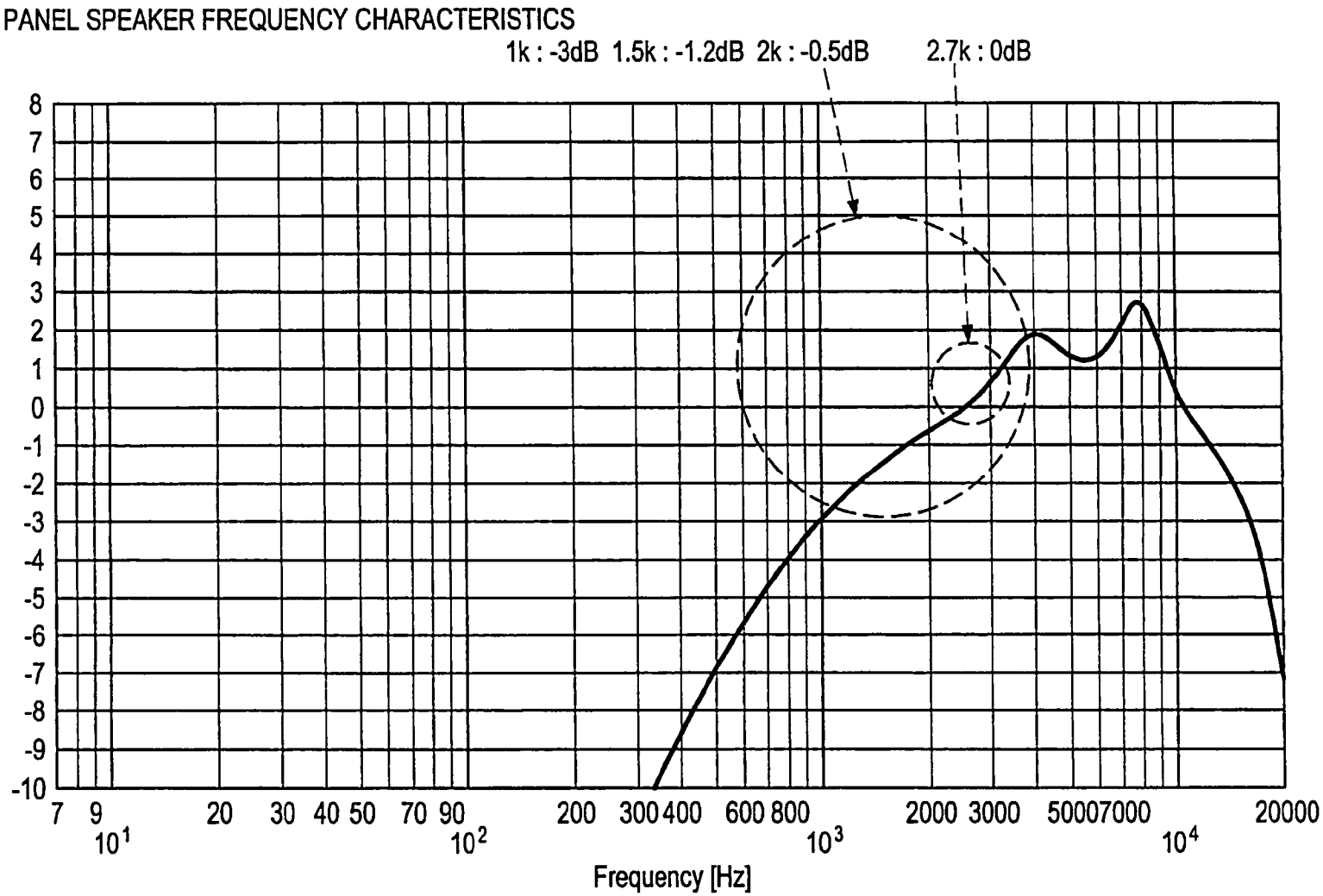
FIG. 7 is a characteristic diagram, as a comparative example, that shows, with respect to the frequency characteristics of the panel speakers shown in FIG. 5, characteristics when the gain at 2.7 kHz is 0 dB.

FIG. 7 shows, as a comparative example. characteristics in which, with respect to the frequency characteristics of the panel speakers 120 shown in FIG. 5, when the gain at 2.7 kHz is 0 dB, gain deteriorates below 2.7 kHz. In this case, as the crossover range with the frequency characteristics of the main speakers 130 becomes small, even when delay is provided the perception that the sound is coming from the display panel 110 as a whole is attenuated, resulting in a feeling that a display area has contracted in the vertical direction. Therefore, as shown in FIG. 5, in a state in which overlap with the frequency characteristics of the main speakers 130 is provided, by delaying the output of the main speakers 130 with respect to the panel speakers 120, the perception can be imparted to the viewer that the sound is being generated from the display panel 110 as a whole.

Figure 8:
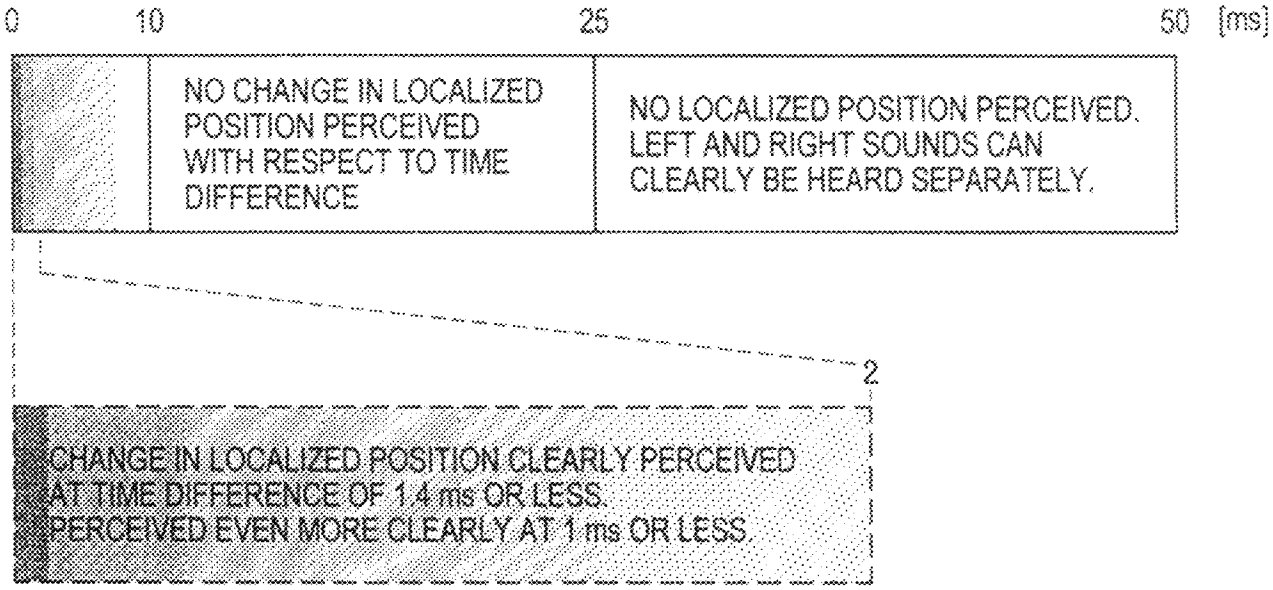
FIG. 8 is a schematic diagram illustrating precedence effect.

FIG. 8 is a schematic diagram illustrating the precedence effect. Here, the precedence effect is a human sensory effect in which a sound source is perceived as being in a direction of audio that first enters the ear. FIG, 8 shows changes in localized position (direction) of a sound image (sound source) when two sound sources output a same audio, and a delay time is set over a range of 0 to 50 [ms].

As shown in FIG. 8, when the delay time is 1.4 [ms] or less, changes in localized position with respect to the delay time can definitely be perceived. On the other hand, when the delay time is 10 [ms] or more, changes in localized position with respect to the delay time cannot be perceived. Additionally, when the delay time is 25 [ms] or more, the localized position of the sound source is not perceived, and it sounds as if the sound is coming independently from two sound sources. From these results, when the delay time is 2 [ms] or less, it is possible to cause changes in the localized position.

Figure 9:
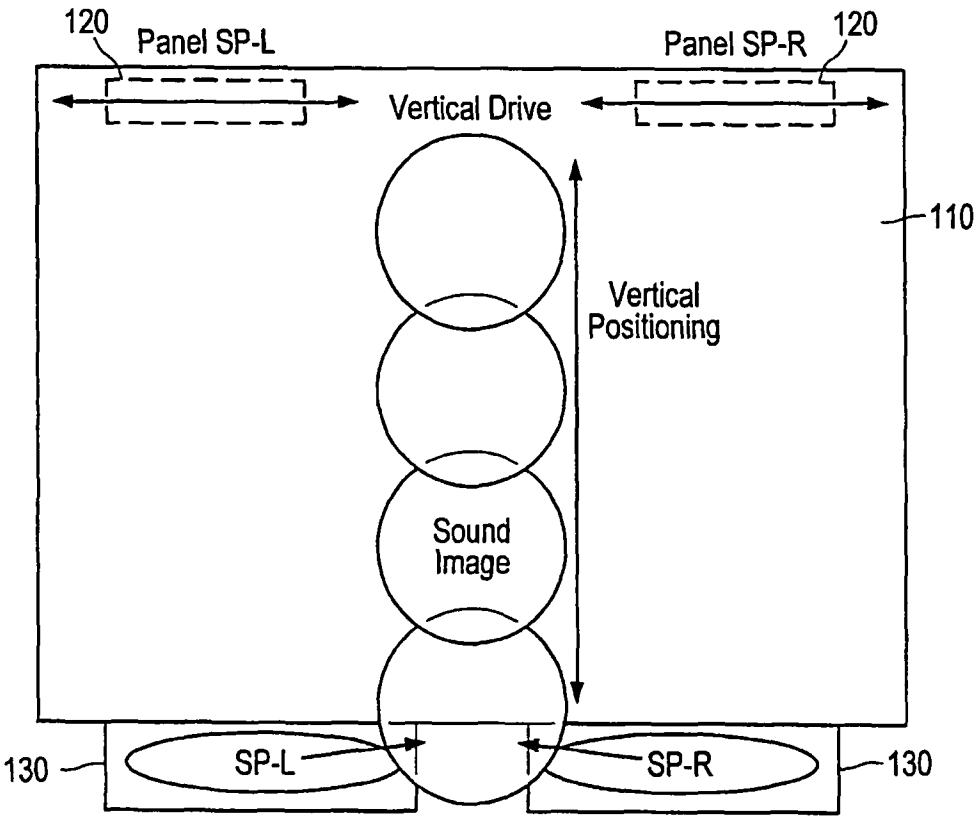
FIG. 9 is a diagram that schematically shows a localized position of a sound image of the main speakers 130 rising due to the precedence effect.

FIG. 9 is a diagram that schematically shows the localized position of the sound image of the main speakers 130 rising, due to the precedence effect. As described above, the main speakers 130 are point sound sources, but, by outputting the sound of the panel speakers 120 in advance, the localized position of the sound image of the main speakers 130 is raised. Further, as the panel speakers 120 are surface sound sources, the sound image of the main speakers 130, whose localized position has been raised, is integrated with the sound of the panel speakers 120, and it is thus possible to impart the perception that the sound of the panel speakers 120 and of the main speakers 130 is being generated from the whole screen of the display panel 110. Note that, in the present specification and appended drawings, the raising of the position of the sound image by the precedence effect is referred to as vertical positioning.

The amount by which the sound image of the main speakers 130 is raised can be freely varied by the delay time. When the delay time is increased, the precedence effect is stronger, and the source of sound moves further upward. For example, by increasing the delay time, the source of sound can be set in the vicinity of an upper edge of the display panel 110, and by further increasing the delay time, the source of sound can be set to be above the upper edge of the display panel 110.

As described above, the panel speakers 120 are flat panel speakers (surface sound sources) that cause the rear panel 122 to vibrate by vertical drive, and speakers using piezo elements can be used. Note that the panel speakers 120 are not limited to this example, and may be speakers that use another method. However, by making the panel speakers 120 surface sound sources, when raising the localized position of the sound image of the main speakers 130, it is possible to integrate the sound, and realize a high sound quality.

As a result, according to the present embodiment, when seen from the front of the display panel 110, even if both the panel speakers 120 and the main speakers 130 are not visible to the user, the viewer can be caused to perceive the source of sound as being approximately the center of the display panel 110. A cosmetic design that is highly satisfactory to the user can therefore be achieved, in which the speakers are not at all visible.

According to the present embodiment, raising the localized position of the sound image using vertical positioning can be applied in a versatile manner to larger displays. When considering the versatile application to displays of various sizes, an optimum delay value has a correlation to a virtual sound source position of the sound created by the main speakers 130 and to a physical distance between the left and the right panel speakers 120. Hereinafter, this point will be explained in more detail with reference to FIG. 10 to FIG. 12.

Figure 10:
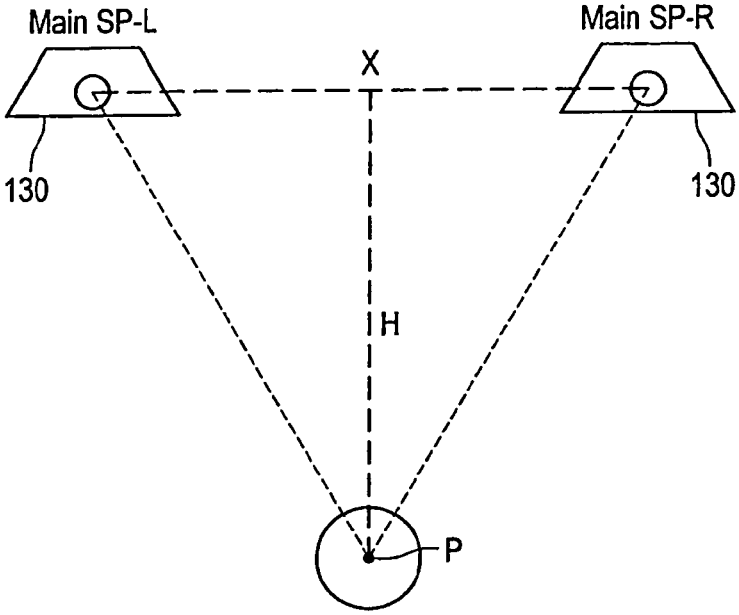
FIG. 10 is a schematic diagram showing a virtual sound image position by the main speakers that are point sound sources.

FIG. 10 is a schematic diagram showing a virtual sound image position by the main speakers 130 that are point sound sources. As shown in FIG. 10, a sound field created by the point sound sources is a regular triangle. A distance X between the point sound sources forms one side of the regular triangle and an apex P is the virtual sound image position.

Here,

X is a distance between two point sound sources L and R (a distance between the left and right main speakers 130), and H a distance between a straight line that joins the left and right main speakers 130 and the virtual sound image position P.

Given this, the following Formula (1) is obtained:

$$H=X*\sqrt{3}/2 \quad (1)$$

Figure 11:
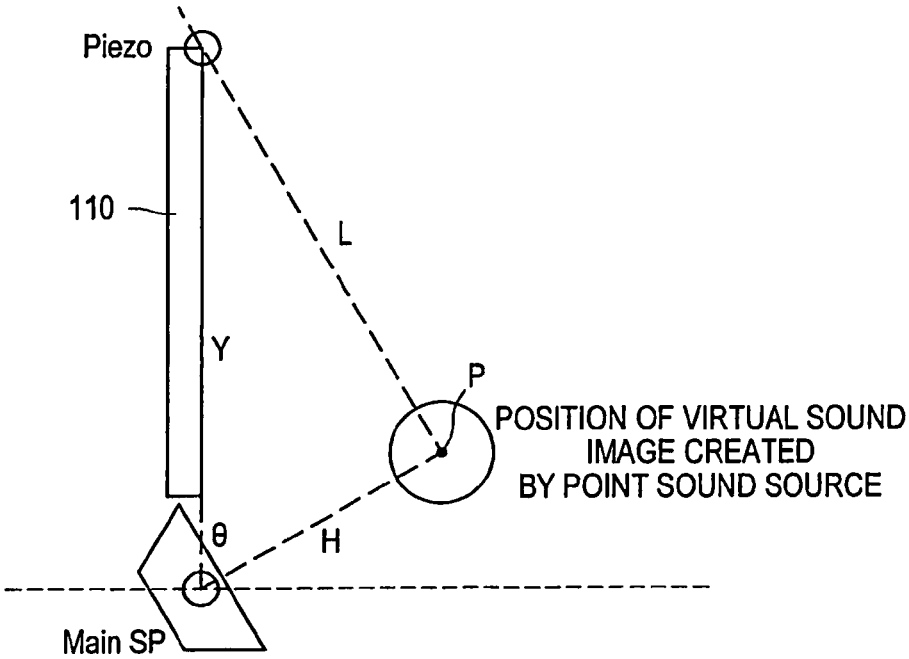
FIG. 11 is a diagram showing a distance between a virtual sound image position P and the panel speakers.

FIG. 11 is a diagram showing a distance between the virtual sound image position P and the panel speakers 120, and schematically shows a state in which the display panel 110 is seen from a left side surface. In FIG. 11, similarly to FIG. 10, here H is the distance between the straight line that joins the left and the right main speakers 130 and the virtual sound image position P.

Further, in FIG. 11:

Y is a distance between the straight line that joins the left and the right main speakers 130 and a straight line that joins the left and the right panel speakers 120, and L is a distance between the straight line that joins the left and the right panel speakers 120 and the virtual sound image position P.

Therefore, the following Formula (2) is obtained:

$$L=\sqrt{(Y*Y+H*H-2*Y*H*\cos(\theta))} \quad (2)$$

Figure 12:
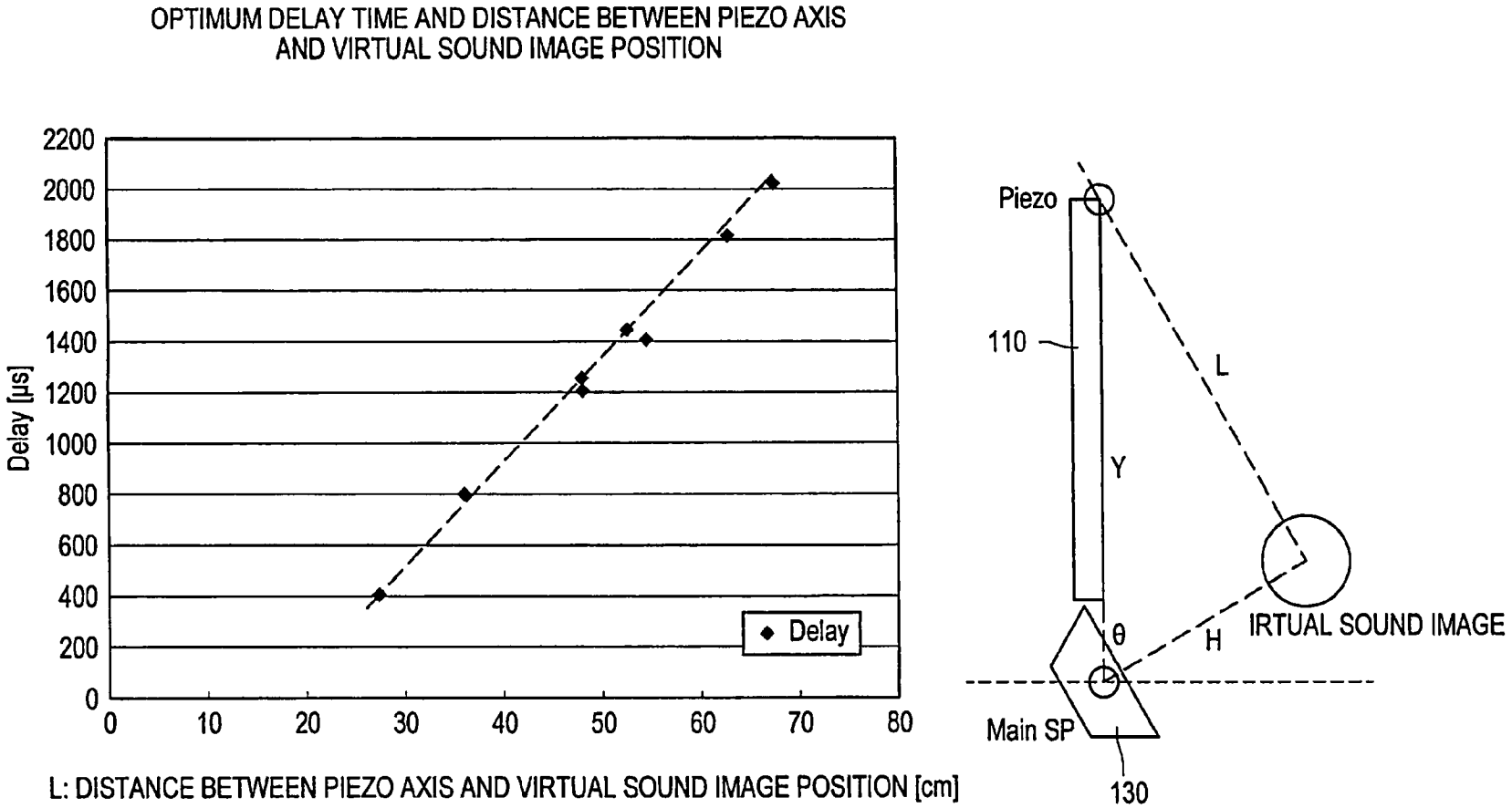

FIG. 12 is a characteristic diagram showing a relationship between a value of the above-described L and an optimum delay value. FIG. 12 shows a case in which, when the value of L is set to each value in a range of approximately 20 cm to 70 cm, the optimum delay value is measured that causes the sound source position to be in the center of the display panel 110 in the height direction, due to the precedence effect. As shown in FIG. 12, by increasing the delay value as the value of L becomes larger, the localized position of the sound image of the main speakers 130 can be raised, and the source of sound can be the center of the display panel 110 in the height direction.

FIG. 13 is a table that shows, for a variety of sizes of the display panel 110, results of calculating the optimum delay time in order to localize the source of sound in the center of the display panel 110 in the height direction. Here, for each of samples 1 to 7 shown in FIG. 13, X=25 cm and H=21.65 cm. As can be seen clearly from the results of the samples 3 to 9, when the value of L is equal to or less than approximately 63 cm, by adjusting the delay value to 1.8 [msec] or less, the sound image position can be localized in the center of the display panel 110 in the height direction. On the other hand, when the value of L is greater than approximately 65 cm, the localized position cannot be raised unless the delay value is larger than 2000 μsec, and further, an adverse effect is that the sound of the panel speakers 120 and of the main speakers 130 is perceived as separate sound. Therefore, in order to localize the sound image in the center of the display panel 110 in a state in which the sound of the panel speakers 120 and the main speakers 130 is heard in an integrated manner, it is preferable for the delay value to be 2000 μsec or less.

4. Structure to Raise Localized Position of Sound Image of Woofer

Next, a relationship between the woofer 140 and the main speakers 130 will be explained. As described above, with the panel speakers 120 and the main speakers 130, a superimposed area of frequencies of both the sets of speakers is created. Then, by outputting the audio of the panel speakers 120 in advance of the audio of the main speakers 130, it is possible to localize the sound image in the center of the display panel 110, without any restrictions caused by the size of the display panel 110.

In the present embodiment, in addition to the above, by optimally adjusting a timing of the audio of the woofer 140, it is possible to localize a sound image generated by the woofer 140 in the center of the display panel 110. In this way, the user can also perceive a generation source of deep bass sound with low range frequencies as being the center of the display panel 110, and it is possible to listen to realistic audio along with viewing video.

Figure 14:
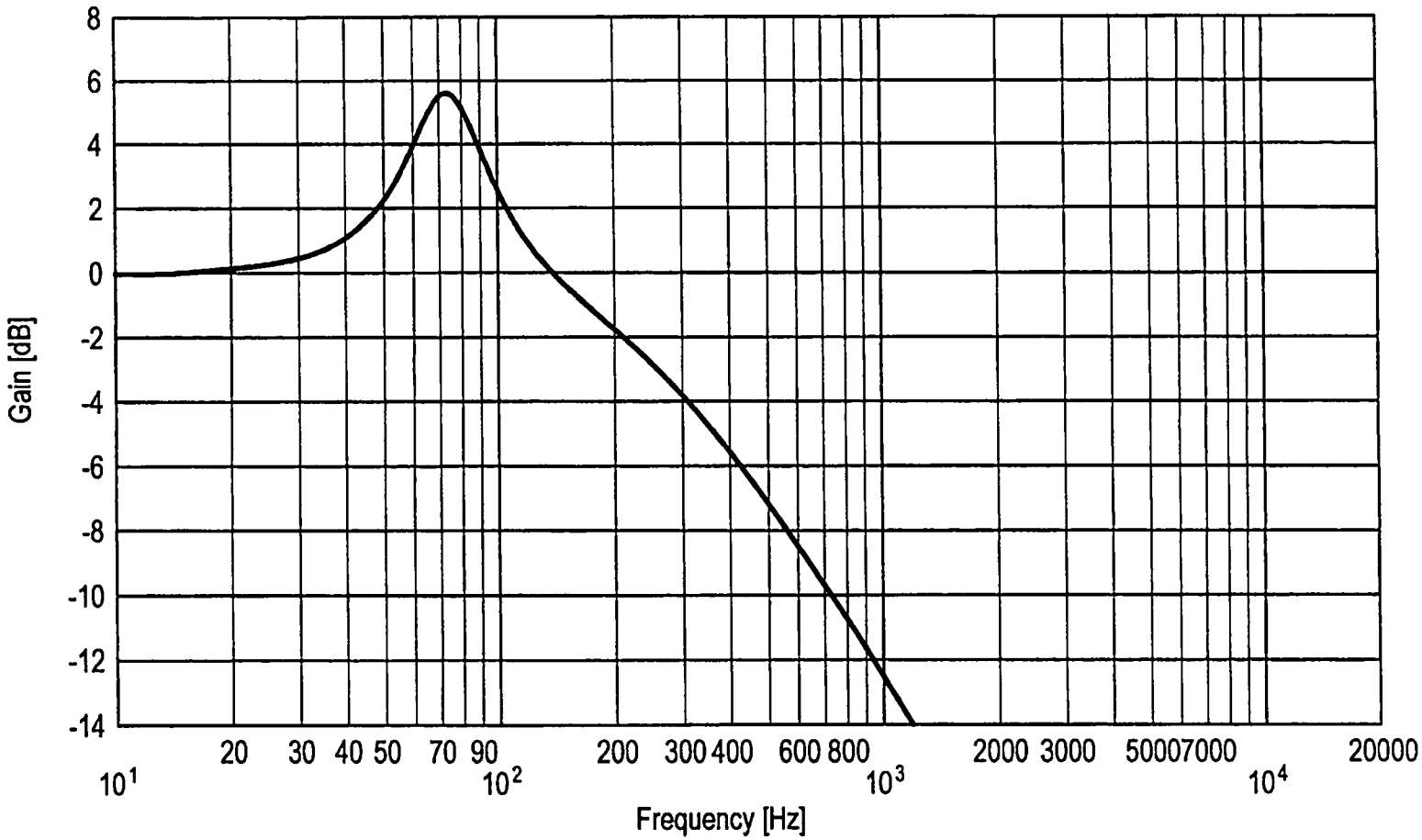
FIG. 14 is a characteristic diagram showing frequency characteristics of the woofer.

In order to realize the above, delay is also adjusted between the woofer 140 and the main speakers 130. FIG. 14 is a characteristic diagram showing frequency characteristics of the woofer 140. The woofer 140 in FIG. 14 mainly generates sound of a frequency of 300 Hz or less. Then, in order to raise the localized position of the bass sound image, control is performed such that the audio of the woofer 140 is generated in advance of the audio from the main speakers 130 by an extremely small time period. Here also, the extremely small time period is 2 msec or less.

In order to generate the bass sound, a delay occurs in the woofer 140 from when the signal is transmitted to actually generating the sound. Furthermore, in the three-way system, by delay etc, of the signal transfer, delay occurs in the system as a whole, and thus a delay occurs in the output of the sound from the woofer 140. For that reason, a predetermined delay time is provided, and, by causing the sound from the woofer 140 to be output in advance, it is possible to match the output timings of the audio of the woofer 140 and of the main speakers 130.

If the output timings of the woofer 140 and the main speakers 130 are matched, a sense of integration of the sound of the woofer 140 and the main speakers 130 arises, and presence of each of the individual sounds is lost. Then, as the bass sound generated from the woofer 140 has no directivity, and the mid range sound generated by the main speakers 130 has directivity, in a state in which a presence of each of the individual sounds is lost, the viewer feels that the audio is output together from the main speakers 130, which have directivity.

As a result, by outputting the sound of the woofer 140 in advance of the sound of the main speakers 130 by the predetermined time period, it is possible to cause the perception that the bass sound is also generated from the center of the display panel 110.

Furthermore, as shown in FIG. 13, sound of 300 Hz and over is also output from the woofer 140, and sound of this bandwidth overlaps with the sound generated from the main speakers 130. As described above, by outputting the sound from the woofer 140 in advance of the sound from the main speakers 130, the output delay of the woofer 140 and the delay in the system as a whole are cancelled out, and audio output timings of the woofer 140 and the main speakers 130 match. From this state, if the sound of the woofer 140 is output further in advance, the sound that is generated at a time point at which the bass sound of the woofer 140 reaches the position of the display panel 110 is generated in advance of the sound from the main speakers 130. In this state, as the sound of the woofer 140 that has reached the position of the display panel 110 is generated in advance of the sound from the main speakers 130, it is possible to adjust the localized position of the sound image of the bass sound in the vertical direction, by adjusting the output timing of the sound of the woofer 140.

More specifically, in the state in which the sound of the woofer 140 that reaches the display panel 110 is generated in advance of the sound from the main speakers 130, the more the sound of the woofer 140 is in advance of the sound of the main speakers 130, namely, the more the output of the main speakers 130 is delayed in relation to the woofer 140, the higher it is possible to localize the sound image from the woofer 140. Thus, by generating the sound of the woofer 140 further in advance, it is possible to set the generation source of the bass sound to be in the vicinity of the upper edge of the display panel 110, and by generating the sound of the woofer 140 even further in advance, it is possible to set the generation source of the bass sound to be above the upper edge of the display panel 110.

In the above-described manner, the sound is generated from all of the panel speakers 120, the main speakers 130 and the woofer 140 in a state in which the delay between the main speakers 130 and the panel speakers 120 is adjusted, and the delay between the main speakers 130 and the woofer 140 is adjusted. As a result, it is possible to cause the viewer to perceive all the sound (the high range, mid range and low range sound) as being generated together from the display panel 110. It thus becomes possible to completely optimize the position of the video and the position of the sound, and makes possible the viewing of contents with an extremely high sense of realism, in which it seems as if the sound is generated from the video itself.

5. Function Block Structure of Television Receiver

Figure 15:
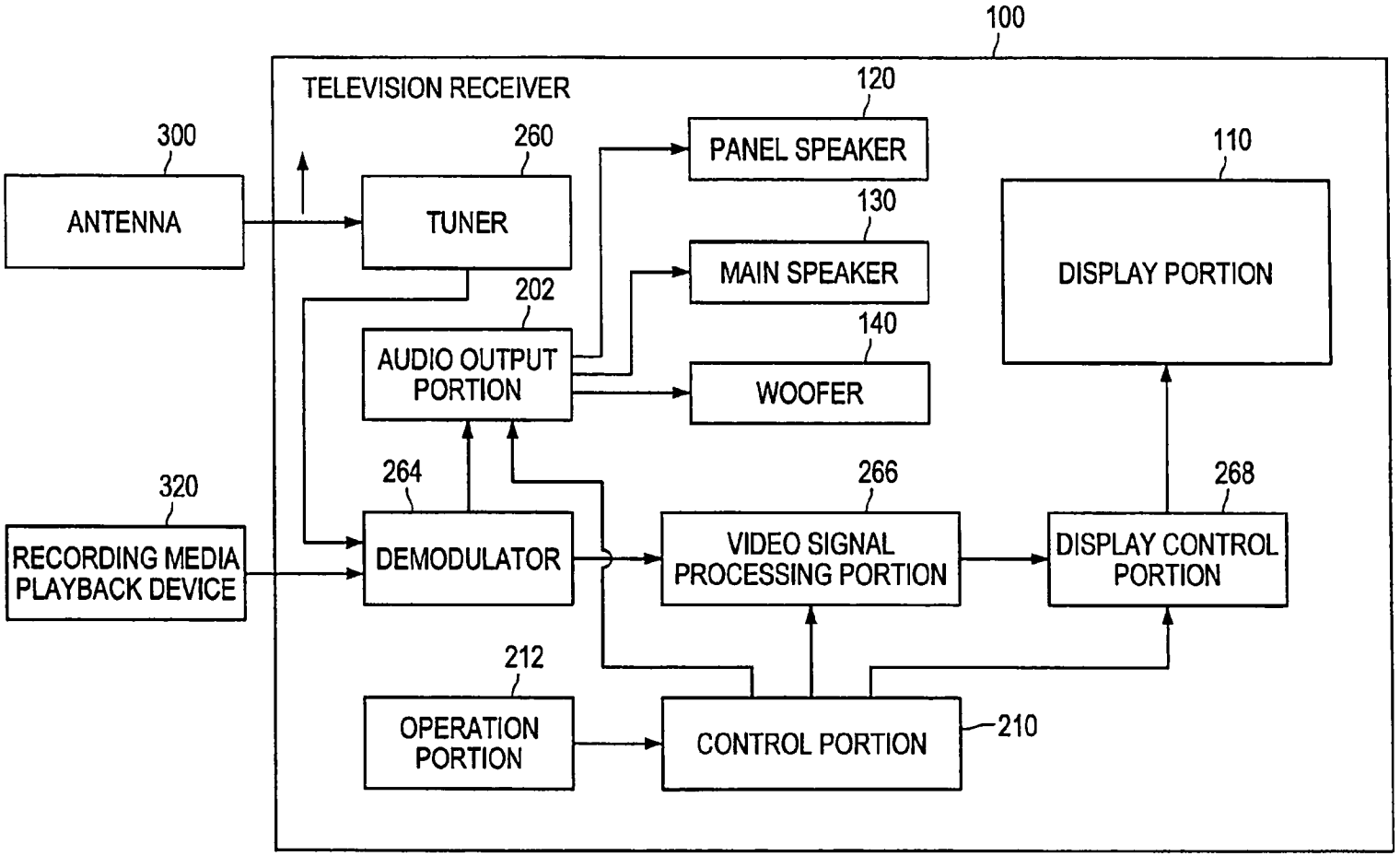
FIG. 15 is a block diagram showing the television receiver according to the present embodiment.

Next, a structure of the television receiver 100 according to the present embodiment will be explained with reference to FIG. 15. FIG. 15 is a block diagram showing the television receiver 100 according to the present embodiment. The television receiver 100 includes, for example, a tuner 260, a demodulator 264, an audio output portion 202, the main speakers 130, the panel speakers 120 and the woofer 140. In addition, the television receiver 100 includes a video signal processing portion 266, a display control portion 268, the display panel 110, a control portion 210 and an operation portion 212.

The television receiver 100 is connected to an antenna 300 and receives television broadcast signals. In addition, the television receiver 100 is connected to a recording media playback device 320, and receives video/audio playback signals of content recorded on recording media. The recording media playback device 320 is, for example, an optical disk playback device, such as a DVD or Blu-ray Disc playback device, or a hard disk playback device etc. In addition, the television receiver 100 may be connected to a network (not shown in the figures), such as the Internet, and may receive video signals of content that is distributed by streaming and of content that can be downloaded.

The tuner 260 receives television broadcast signals via the antenna 300. The tuner 260 extracts and amplifies broadcast signals of a specific frequency. The tuner 260 transmits the thus generated signals to the demodulator 264.

The demodulator 264 receives the broadcast signals from the tuner 260, or receives video playback signals from the recording media playback device 320. The demodulator 264 then performs demodulation processing on the broadcast signals or the video/audio signals. Further, the demodulator 264 performs demultiplex processing and separates the demultiplexed signals into video signals and audio signals. In addition, the demodulator 264 performs processing to decode the signals that have been encoded by a standard such as MPEG etc. The demodulator 264 transmits the processed signals to the audio output portion 202 and the video signal processing portion 266.

The audio output portion 202 performs specific signal processing on the demodulated audio signals, and outputs the processed audio signals to the panel speakers 120, the main speakers 130 and the woofer 140. The audio output portion 202 includes each of the structural members illustrated in FIG. 3 and FIG. 4.

Based on the audio signals received from the audio output portion 202, the panel speakers 120, the main speakers 130 and the woofer 140 output audio of a television broadcast program, content recorded on the recording media etc.

The video signal processing portion 266 performs, on the video signals received from the demodulator 264, scaling processing in accordance with a number of pixels of the display panel 110, color correction processing and edge enhancement processing etc. The video signal processing portion 266 transmits the processed video signals to the display control portion 268.

Based on the video signals received from the video signal processing portion 266, the display control portion 268 drives the display panel 110 and causes the video to be displayed on the display panel 110. The display panel 110 is, for example, a liquid crystal display (LCD), an organic EL display, a plasma display or the like. The display panel 110 displays video of a television broadcast program or of content recorded on the recording media and so on. Further, the display panel 110 displays a setup menu screen for the television receiver 100 or for the recording media playback device 320 etc. that is connected to the television receiver 100, The control portion 210 has a microcomputer that is formed of, for example, a combination of a central processing unit (CPU), a read only memory (ROM) and a random access memory (RAM) The control portion 210 functions, by a program, as an arithmetic processing device and a control device, and controls each of the above-described structural members of the television receiver 100. In addition, the control portion 210 controls each of the structural members of the television receiver 100 based on signals received from the operation portion 212.

The operation portion 212 receives an operation by the user and transmits operation signals to the control portion 210 based on the operation by the user. The operation portion 212 is, for example, formed of a variety of buttons and switches provided on a main body of the television receiver 100, by a mouse or by a remote control that can perform wireless communication with the control portion 210.

According to the above-described embodiment, it is possible to localize the positions of the sound images of the panel speakers 120, the main speakers 130 and the woofer 140 to the position of the display panel 110. As a result, sound quality is not lost, and audio can be provided to the viewer that has a high sense of reality in which the position of the video is the sound source.

It should be understood by those skilled in the art that various modifications, combinations, sub-combinations and alterations may occur depending on design requirements and other factors insofar as they are within the scope of the appended claims or the equivalents thereof.

What is claimed is:

1. A display device comprising:

a display portion that displays video;

a first audio output portion that outputs stereo audio of a high frequency range, and that is a surface sound source positioned on a rear surface of the display portion, on one of an upper section and a lower section of the display portion;

a second audio output portion that outputs stereo audio of a lower frequency range than the first audio output portion, and that is one of a surface sound source and a point sound source positioned on the rear surface of the display portion, on one of the upper section and the lower section of the display portion on which the first audio output portion is not positioned;

a third audio output portion that outputs audio at an even lower frequency range than the second audio output portion;

a processing portion that causes output of the second audio output portion to be (i) later than output of the first audio output portion and (ii) later than output of the third audio output portion, wherein a time by which the output of the second audio output portion is delayed with respect to the output of the first audio output portion is 2 ms or less, and wherein a time by which the output of the second audio output portion is delayed with respect to the output of the third audio output portion is 2 ms or less.

2. The display device according to claim 1, wherein an overlapping area is created between frequencies of the audio output by the first audio output portion and frequencies of the audio output by the second audio output portion.

3. The display device according to claim 2, wherein the overlapping area is a bandwidth between 1 kHz and 3 kHz.

4. The display device according to claim 1, wherein an overlapping area is created between frequencies of the audio output by the second audio output portion and frequencies of the audio output by the third audio output portion.

5. The display device according to claim 1, wherein the processing portion has digital signal processor with a plurality of delay portions configured therein.

6. The display device according to claim 5, wherein the digital signal processor has three delay portions, in which each delay portion is respectively associated with one of the first audio output portion, the second audio output portion or the third audio output portion.

7. A display device comprising:

a display portion that displays video;

a first audio output portion that outputs stereo audio of a high frequency range, and that is a surface sound source positioned on a rear surface of the display portion, on one of an upper section and a lower section of the display portion;

a second audio output portion that outputs stereo audio of a lower frequency range than the first audio output portion, and that is one of a surface sound source and a point sound source positioned on the rear surface of the display portion, on one of the upper section and the lower section of the display portion on which the first audio output portion is not positioned;

a delaying portion that delays output of the second audio output portion to be later than output of the first audio output portion;

a third audio output portion that outputs audio at an even lower frequency range than the second audio output portion; and a second delaying portion that delays output of the second audio output portion to be later than output of the third audio output portion, wherein an overlapping area is created between frequencies of the audio output by the second audio output portion and frequencies of the audio output by the third audio output portion, wherein a time by which the output of the second audio output portion is delayed with respect to the output of the first audio output portion is 2 ms or less, and wherein a time by which the output of the second audio output portion is delayed with respect to the output of the third audio output portion is 2 ms or less.

8. The display device according to claim 7, wherein the third audio output portion is positioned below the display portion.

9. An audio output device comprising:

a first audio output portion that outputs audio of a high frequency range, and that is a surface sound source;

a second audio output portion that outputs audio of a lower frequency range than the first audio output portion, that is one of a surface sound source and a point sound source and that is positioned separated from the first audio output portion;

a third audio output portion that outputs audio at an even lower frequency range than the second audio output portion;

a processing portion that causes output of the second audio output portion to be later than output of the first audio output portion and later than output of the third audio output portion, and causes a localized position of a sound image by the second audio output portion to move toward the first audio output portion, wherein a time by which the output of the second audio output portion is delayed with respect to the output of the first audio output portion is 2 ms or less, and wherein a time by which the output of the second audio output portion is delayed with respect to the output of the third audio output portion is 2 ms or less.

10. The audio output device according to claim 9, wherein an overlapping area is created between frequencies of the audio output by the first audio output portion and frequencies of the audio output by the second audio output portion.

11. The audio output device according to claim 10, wherein the overlapping area is a bandwidth between 1 kHz and 3 kHz.

12. The audio output device according to claim 9, wherein an overlapping area is created between frequencies of the audio output by the second audio output portion and frequencies of the audio output by the third audio output portion.

13. The audio output device according to claim 9, wherein the processing portion has digital signal processor with a plurality of delay portions configured therein.

14. The audio output device according to claim 13, wherein the digital signal processor has three delay portions, in which each delay portion is respectively associated with one of the first audio output portion, the second audio output portion or the third audio output portion.

* * * * *